US005183977A

United States Patent [19]

Horitani

[11] Patent Number: 5,183,977

[45] Date of Patent: Feb. 2, 1993

[54] MUFFLER ASSEMBLY OF INTERNAL COMBUSTION ENGINE

[75] Inventor: Yoshihiro Horitani, Hamamatsu, Japan

[73] Assignee: Suzuki Kabushiki Kaisha, Japan

[21] Appl. No.: 666,865

[22] Filed: Mar. 8, 1991

[30] Foreign Application Priority Data

Mar. 14, 1990 [JP] Japan ..... 2-61154

[51] Int. Cl.[5] ..... F01N 1/08

[52] U.S. Cl. ..... 181/266; 181/269; 181/272; 181/273; 181/282

[58] Field of Search ..... 181/264, 265, 266, 268, 181/269, 272, 273, 275, 276, 282

[56] References Cited

U.S. PATENT DOCUMENTS 4,416,350 11/1983 Hayashi ..... 181/272
4,972,921 11/1990 Takada et al. ..... 181/265 X
5,025,890 6/1991 Hisashige et al. ..... 181/265 X

*Primary Examiner*—Michael L. Gellner
*Assistant Examiner*—K. Dang
*Attorney, Agent, or Firm*—Bruce L. Adams; Van C. Wilks

[57] ABSTRACT

A muffler assembly of an internal combustion engine comprises an inner casing in which is defined a first expansion chamber into which is inserted one end of the exhaust pipe having another end connected to an exhaust gas port of the engine, an outer casing disposed outside the inner casing so as to define second and third expansion chambers between the inner and outer casings, a first baffle pipe disposed so as to mutually communicate the first and second expansion chambers, a second baffle pipe disposed so as to mutually communicate the second and third expansion chambers, and a tail pipe member disposed so as to communicate the third expansion chamber and the outside of the outer casing. The inner and outer casings are formed by two plate members, respectively, which are secured together when the muffler assembly is assembled. A sound absorption chamber is formed around the outer periphery of the tail pipe.

20 Claims, 2 Drawing Sheets

MUFFLER ASSEMBLY OF INTERNAL COMBUSTION ENGINE

BACKGROUND OF THE INVENTION

The present invention relates to an improvement of a muffler assembly of an internal combustion engine.

An internal combustion engine is provided with an exhaust port to which a front end portion of an exhaust pipe is connected and through which an engine exhaust gas is exhausted, and a muffler is connected to a rear end portion of the exhaust pipe to silence noise of the exhaust gas, which is thereafter exhausted outward.

A conventional muffler of an internal combustion engine is generally composed of an outer casing defining therein a plurality of silencer chambers divided by means of partitions in a row. The exhaust pipe is connected to the frontside the silencer chamber and a tail pipe is connected to the rearside silencer chamber. The respective silencer chambers are communicated with baffle pipes to thereby silence the noise of the exhaust gas and then exhaust the gas outward through the tail pipe. Such a muffler is disclosed in, for example, Japanese Utility Model Laid-open Publication No. 63-196414 or No. 63-93411.

The exhaust gas passing the exhaust pipe and flowing in the silencer chamber is compressed to a relatively high pressure, and particularly, in the frontmost silencer chamber, the inner wall of the casing is impacted or shocked by the intermittent pressure pulsation of the exhaust gas, thus causing metallic noise. In order to obviate this defect, i.e. to reduce or silence the noise, a sound absorption material such as glass wool is applied to the inner surface of the casing, this working, however, being troublesome and involving increased manufacturing cost.

SUMMARY OF THE INVENTION

An object of the present invention is to substantially eliminate the defects encountered in the prior art such as described above and to provide an improved muffler assembly of an internal combustion engine capable of substantially preventing the impact noise of the engine exhaust gas from leaking outward.

This and other objects can be achieved according to the present invention by providing a muffler assembly of an internal combustion engine provided with an exhaust gas port, the muffler assembly being connected to an exhaust pipe having one end connected to the exhaust gas port of the engine, the muffler assembly comprising an inner casing in which is defined a first expansion chamber into which another end of the exhaust pipe is inserted, an outer casing disposed outside the inner casing so as to define second and third expansion chambers between the inner and outer casings, a first baffle pipe disposed so as to mutually communicate the first and second expansion chambers, a second baffle pipe disposed so as to mutually communicate the second and third expansion chambers and a tail pipe means disposed so as to communicate the third expansion chamber and the outside of the outer casing.

The inner casing is composed of two plate members having outwardly expanded portions between which the first expansion chamber is defined and flat portions secured to each other when the inner casing is assembled, and the outer casing is composed of two plate members expanded outwardly so as to define the second and third expansion chambers between the inner and outer casings when both two plate members are secured together with the two plate members of the inner casing.

According to the muffler assembly of an internal combustion engine of the characters described above, the engine exhaust gas is first entered into the first expansion chamber which is isolated from the external portion of the outer casing, then into the second expansion chamber via the first baffle pipe, then into the third expansion chamber via the second baffle pipe and finally exhausted outward via the tail pipe.

Since the first expansion chamber is defined inside the inner casing isolated inward of the outer casing, the pulsation impact noise caused by the exhaust gas entering into the first expansion chamber through the exhaust pipe can be attenuated by the outward locations of the second and third expansion chambers, thus effectively reducing the radiation of the noise caused by the impact of the exhaust gas, whereby the application of the sound absorption material to the outer casing in the conventional muffler can be eliminated.

In addition, the inner casing and the outer casing, which are composed of press-formed two plate members, are firmly secured with each other, so that the first, second and third expansion chambers can be surely partitioned, thus substantially reducing the exhaust noise from leaking outward. The attachment of the exhaust pipe and the baffle pipes can be made firmly with high rigidity, thus substantially eliminating the generation of the vibration of the entire muffler structure.

DESCRIPTION OF THE PREFERRED EMBODIMENT

Figure 4:
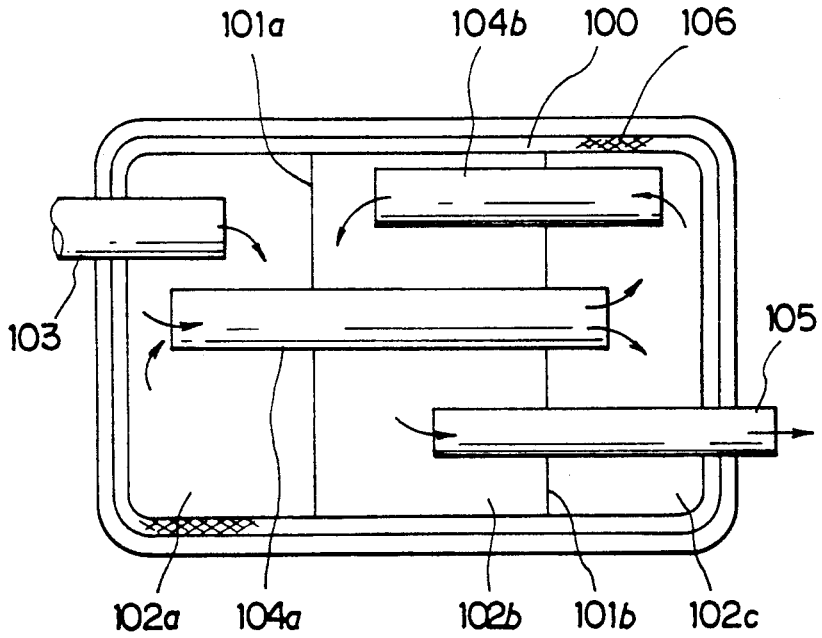
FIG. 4 PRIOR ART
FIG. 4 is a schematic illustration of a section of a conventional muffler of an internal combustion engine.

For a better understanding of the present invention, a conventional muffler of an internal combustion engine is first described hereunder with reference to FIG. 4.

Referring to FIG. 4, a muffler of an internal combustion engine is composed of an outer casing 100 defining therein a plurality of silencer chambers 102 divided by means of partitions 101 in a row. An exhaust pipe 103 is communicated with the frontmost silencer chamber 102*a* and a tail pipe 105 is communicated with an intermediate silencer chamber. The respective silencer chambers are communicated with baffle pipes 104 to thereby silence the noise of the exhaust gas and then exhaust the gas outward through the tail pipe 105. The baffle pipe 104*a* extends throughout the respective silencer chambers 102*a* to 102*c* through the partitions 101*a* and 101*b* and the baffle pipe 104*b* extends through the partition 101*b*. The tail pipe 105 is communicated with the silencer chamber 102*b*. According to this arrangement, the exhaust gas entered into the muffler flows in the arrowed directions and is finally exhausted through the tail pipe 105 outward.

In order to reduce or substantially silence the impact noise caused by the impact of the exhaust gas against inner wall of the casing, a sound absorption material 106 such as glass wool is applied to the inner surface of the casing, this working, however, being troublesome and involving increased manufacturing cost as described hereinbefore.

The present invention, conceived to overcome the defects of the conventional muffler, will be described hereunder with reference to FIGS. 1 to 3.

Figure 1:
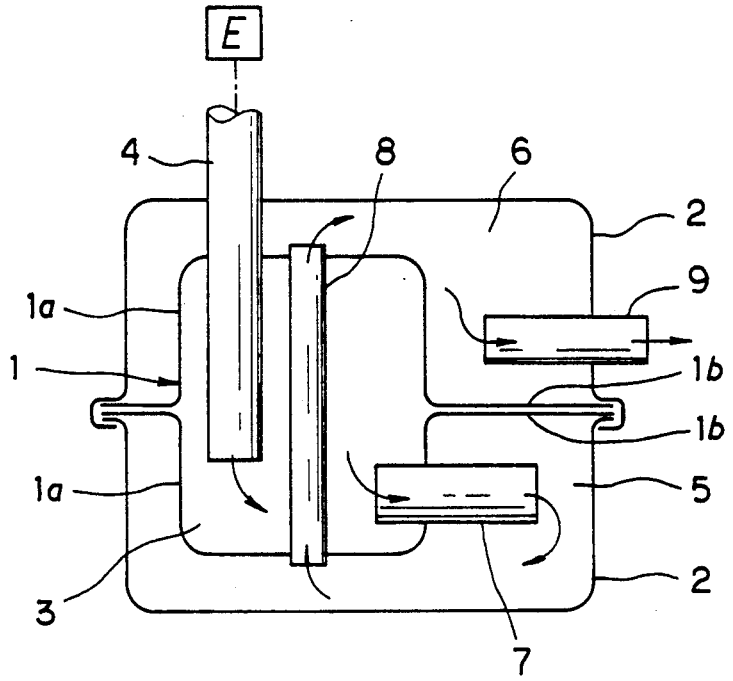
FIG. 1 is an schematic illustration of a section of a muffler assembly of an internal combustion engine according to the present invention.
Figure 2:
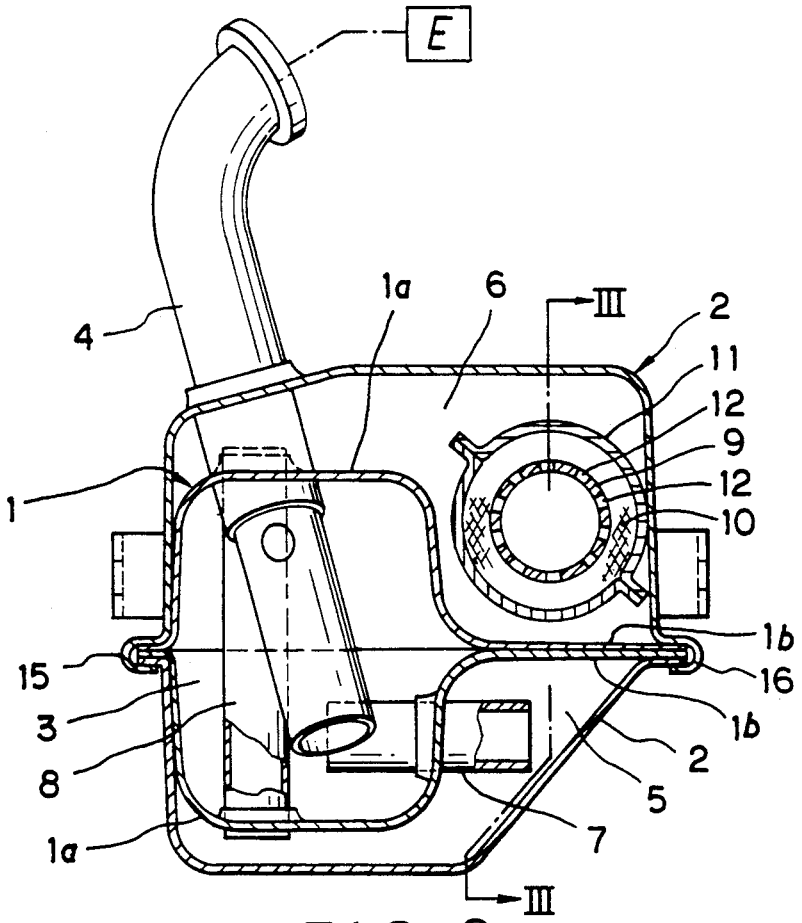
FIG. 2 is a concrete section of the muffler assembly of FIG. 1.
Figure 3:
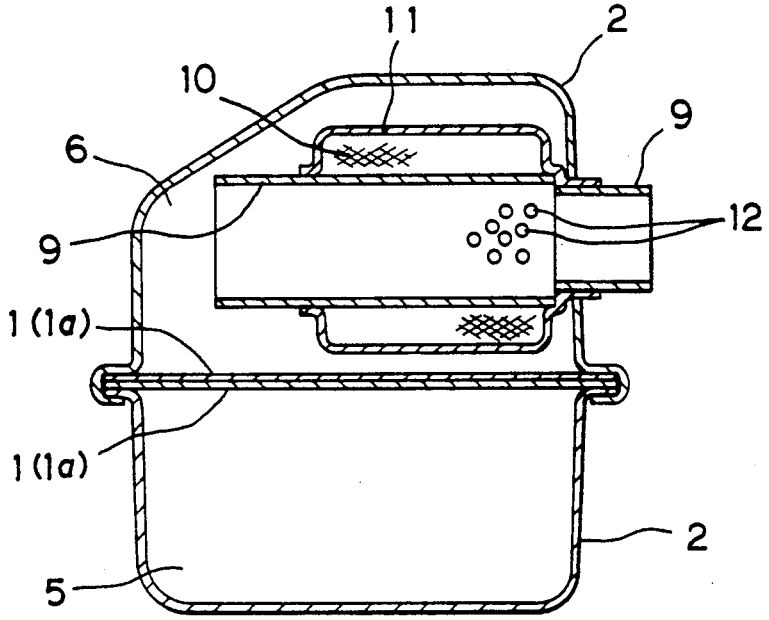
FIG. 3 shows a section taken along the line III—III of FIG. 2.

Referring to FIGS. 1 to 3 showing one preferred embodiment of a muffler assembly of an internal combustion engine according to the present invention, the muffler assembly comprises an outer casing which is composed of two casing sections in the form of plate members 2 and 2 (called an outer plate 2 hereinafter) and an inner casing which is disposed inside the outer casing and composed of two casing sections in the form of plate members 1 and 1 (called an inner plate 1 hereinafter). The inner plates 1 and 1 are provided with outwardly expanded portions 1*a* and a horizontal portions 1*b*, as viewed, which are closely mated with each other so that a first expansion chamber 3 is formed inside the expanded portions 1*a* and 1*a*. Such inner plates 1 may be formed by press working, for example. The outer plates 2 and 2 are disposed with spaces outside the inner plates 1 and 1 and both end portions of the outer plates 2 and 2 are mated with each other and secured at portions 15 and 16 together with the inner plates 1 and 1 in a box-shape, by means of welding or heming working, for example, so as to form second and third expansion chambers 5 and 6 therebetween. The outer plates 2 may be also formed by press working, for example.

An exhaust pipe 4 has one end connected to an exhaust port of an internal combustion engine E and the other end penetrating one outer plate 2 and one inner plate 1. The exhaust pipe 4 is secured by such as welding means to the outer plate 2. The other end of the exhaust pipe 4 is opened in the first expansion chamber 3. The interiors of the first and second expansion chambers 3 and 5 are mutually communicated by means of a baffle pipe 7 and the second and third expansion chambers 5 and 6 are mutually communicated by means of a baffle pipe 8 which has both ends opened in the second and third expansion chambers 5 and 6 by penetrating the inner plates 1 and 1, i.e., the first expansion chamber 3. A tail pipe 9 is located so as to communicate the third expansion chamber 6 with a portion external to the muffler assembly by penetrating the outer plate 2 as clearly shown in FIG. 3. As shown in FIG. 2 or 3, a sound absorption chamber 11 comprised of a tubular member may be formed around the tail pipe 9 and a sound absorbing material such as glass wool is packed in the sound absorption chamber 11. In this arrangement, a number of ventilation perforations 12 are formed in a section of the tail pipe 9, thus further enhancing the sound absorption ability. The sound absorption chamber 11 may be formed, in one example, by mating semi-spherical pipe halves.

According to the structure of the muffler assembly of the structure described above, the engine exhaust gas is first entered into the first expansion chamber 3 which is isolated from the external portion of the outer casing, then into the second expansion chamber 5 via the baffle pipe 7, then into the third expansion chamber 6 via the baffle pipe 8 and finally exhausted outward via the tail pipe 9.

As described hereinabove, since the first expansion chamber 3 is defined inside the inner casing which is isolated inward of the outer casing, the pulsation impact noise caused by the exhaust gas entering into the first expansion chamber 3 through the exhaust pipe 4 can be attenuated by the outward locations of the second and third expansion chambers 5 and 6, thus effectively reducing the radiation of the noise caused by the impact of the exhaust gas, whereby the application of the sound absorption material to the outer casing in the conventional muffler such as shown in FIG. 4 can be eliminated.

In addition, the inner casing and the outer casing are firmly secured with each other, so that the first, second and third expansion chambers 3, 5 and 6 can be surely partitioned, thus substantially reducing the exhaust noise from leaking outward. The attachment of the exhaust pipe 4 and the baffle pipes 7 and 8 can be made firmly with high rigidity, thus substantially eliminating the generation of the vibration of the entire muffler structure.

What is claimed is:

1. A muffler assembly of an internal combustion engine provided with an exhaust gas port, the muffler assembly being connected during use to one end of an exhaust pipe which has another end connected to the exhaust gas port of the engine, said muffler assembly comprising:

an inner casing in which is defined a first expansion chamber into which the one end of the exhaust pipe is inserted;

an outer casing disposed outside the inner casing so as to define second and third expansion chambers between the inner and outer casing;

first baffle pipe means disposed so as to mutually communicate the first and second expansion chambers;

second baffle pipe means disposed so as to mutually communicate the second and third expansion chambers; and tail pipe means disposed so as to communicate the third expansion chamber and an outside of the outer casing;

wherein exhaust gas from the exhaust gas port of the engine is first introduced into the first expansion chamber of the inner casing, then flows into the second and third expansion chambers in the outer casing through the first and second baffle pipe means, and is finally exhausted through the tail pipe means.

2. A muffler assembly according to claim 1, wherein said inner casing is composed of two plate members having outwardly expanded portions between which the first expansion chamber is defined and flat portions secured to each other when the inner casing is assembled, and said outer casing is composed of two plate members expanded outwardly so as to define the second and third expansion chambers between the inner and outer casings when both plate members are seemed together with said two plate members of the inner casing

3. A muffler assembly according to claim 1, wherein said tail pipe means comprises an inner tail pipe, an outer cylindrical member disposed outside an outer periphery of the inner tail pipe with a space therebetween and a sound absorption material packed in the space.

4. A muffler assembly according to claim 3, wherein said sound absorption material is a glass wool.

5. A muffler assembly according to claim 3, wherein said inner tail pipe is provided with a number of perforations formed in a wall thereof.

6. A muffler assembly for use with an internal combustion engine, the muffler assembly comprising: an inner casing defining a first expansion chamber receptive of exhaust gas from an internal combustion engine during use of the muffler assembly; an outer casing disposed outside the inner casing with a space between the outer and inner casings; means dividing the space between the outer and inner casings into second and third expansion chambers; a first pipe interconnecting the first and second expansion chambers for flowing the exhaust gas from the first expansion chamber to the second expansion chamber; a second pipe interconnecting the second and third expansion chambers for flowing the exhaust gas from the second expansion chamber to the third expansion chamber; and means for discharging the exhaust gas from the third expansion chamber.

7. A muffler assembly according to claim 6; wherein the first and second pipes comprise unperforated pipes.

8. A muffler assembly according to claim 6; wherein the first and second pipes comprise baffle pipes.

9. A muffler assembly according to claim 6; wherein the inner casing comprises two casing sections connected together to define the inner casing.

10. A muffler assembly according to claim 9; wherein the means dividing the space between the outer and inner casings comprises outward extensions of the two casing sections, the outward extensions extending outwardly to the outer casing and dividing the space into the second and third expansion chambers.

11. A muffler assembly according to claim 10; wherein the first pipe extends through and is connected to one of the inner casing sections.

12. A muffler assembly according to claim 10; wherein the second pipe extends completely through and is connected to the two inner casing sections, one end of the second pipe extending into the second expansion chamber and the other end of the second pipe extending into the third expansion chamber.

13. A muffler assembly according to claim 10; wherein the outer casing comprises two outer casing sections connected together to define the outer casing.

14. A muffler assembly according to claim 13; including means connecting the outer casing section to the outward extensions of the inner casing sections.

15. A muffler assembly according to claim 6; wherein the outer casing comprises two outer casing sections connected together to define the outer casing.

16. A muffler assembly according to claim 6; wherein the means for discharging comprises a tail pipe having one end extending into and another end extending out of the third expansion chamber for flowing exhaust gas out of the third expansion chamber.

17. A muffler assembly according to claim 16; wherein the portion of the tail pipe which extends into the third expansion chamber has a perforated section, a tubular member disposed over the perforated section with a space therebetween, and a sound-absorbing material packed in the space.

18. A muffler assembly according to claim 17; wherein the sound-absorbing material comprises steel wool.

19. A muffler assembly according to claim 6; wherein the second pipe extends completely through the inner casing with the opposite ends of the second pipe extending, respectively, into the second and third expansion chambers.

20. A muffler assembly according to claim 19; including means connecting the first and second pipes to the inner casing.

* * * * *